US010352227B2

(12) United States Patent
Solazzo

(10) Patent No.: US 10,352,227 B2
(45) Date of Patent: Jul. 16, 2019

(54) FLAPPER VALVE DEVICE WITH FUNCTIONAL TESTING

(71) Applicant: Röchling Automotive SE & Co. KG, Mannheim (DE)

(72) Inventor: Domenico Solazzo, Worms (DE)

(73) Assignee: RÖCHLING AUTOMOTIVE SE & CO. KG, Mannheim (DE)

( * ) Notice: Subject to any disclaimer, the term of this patent is extended or adjusted under 35 U.S.C. 154(b) by 166 days.

(21) Appl. No.: 15/176,528

(22) Filed: Jun. 8, 2016

(65) Prior Publication Data

US 2016/0363035 A1 Dec. 15, 2016
US 2017/0191403 A9 Jul. 6, 2017

(30) Foreign Application Priority Data

Jun. 11, 2015 (DE) ..... 10 2015 210 683

(51) Int. Cl.
*F01P 7/10* (2006.01)
*F01P 11/14* (2006.01)

(52) U.S. Cl.
CPC ..... *F01P 7/10* (2013.01); *F01P 11/14* (2013.01); *F01P 2025/00* (2013.01)

(58) Field of Classification Search
CPC ..... F01P 7/10; F01P 11/14; F01P 2025/00
See application file for complete search history.

(56) References Cited

U.S. PATENT DOCUMENTS 4,748,943 A 6/1988 Mayer
5,689,953 A 11/1997 Yamashita et al.
9,217,689 B2 12/2015 Rollinger et al.
9,233,605 B2 1/2016 Hijikata
(Continued)

FOREIGN PATENT DOCUMENTS

CN 103358887 10/2013
CN 103362628 10/2013
(Continued)

OTHER PUBLICATIONS

Search Report issued for German application No. 10 2015 210 683.7 dated Feb. 23, 2016 with machine English translation (16 pages).
(Continued)

*Primary Examiner* — Kevin A Lathers
(74) *Attorney, Agent, or Firm* — Prince Lobel Tye LLP

(57) ABSTRACT

A device for convective cooling of a functional assembly for a motor vehicle includes a fan, which in operation, is designed to move air along a flow axis defined by the design and placement of the fan. A flapper valve device is provided having an air transit opening and a flapper valve assembly disposed therein, with at least one flapper valve provided to change the open-flow cross section of the air transit opening and being adjustable between a closed position and an open position. A control unit is provided. The fan and the flapper valve device are arranged at a distance from each other such that air moved due to operation of the fan then flows through the air transit opening at least when the flapper valve device is in the open position. The control unit is designed to detect at least one operating parameter of the fan.

20 Claims, 5 Drawing Sheets

(56) References Cited

U.S. PATENT DOCUMENTS

Figure 1:
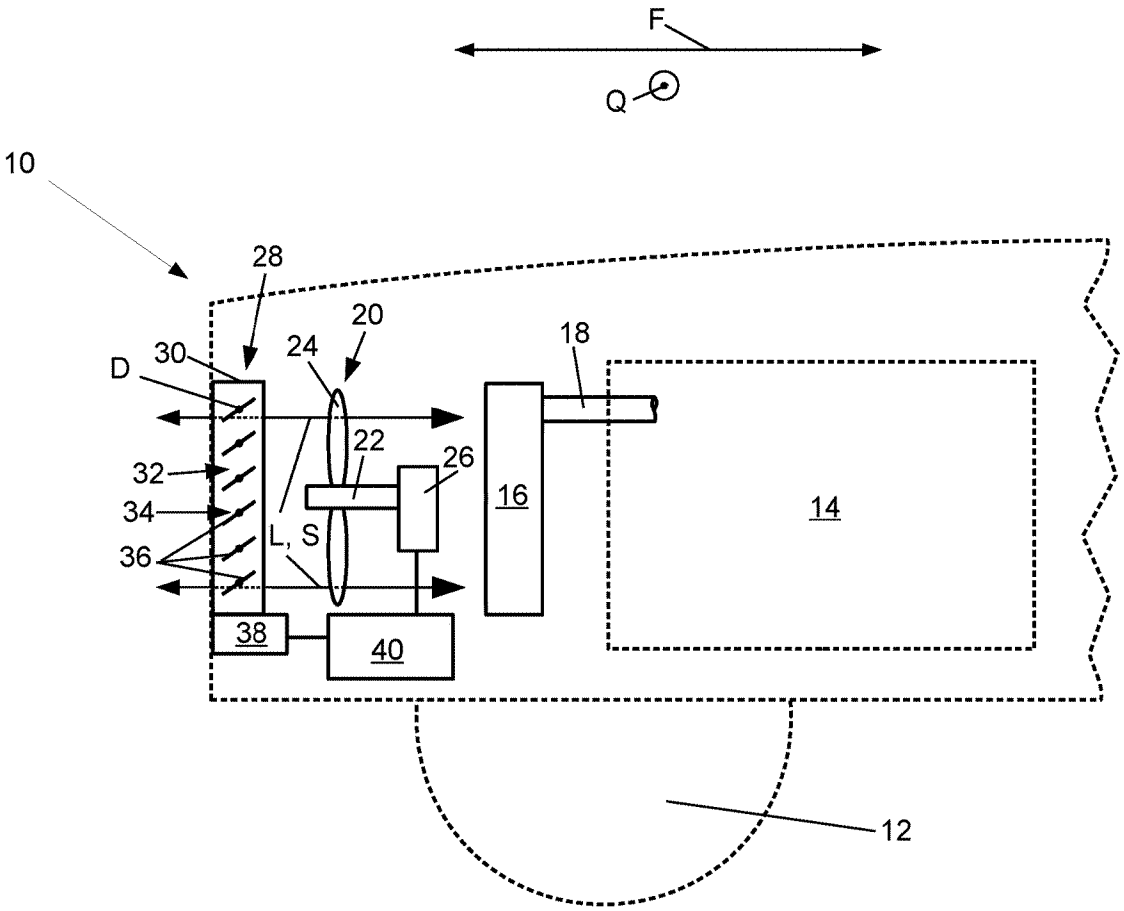

| | | | | |
|---|---|---|---|---|
| 2011/0061405 | A1* | 3/2011 | Watanabe | B60H 1/3227 62/61 |
| 2013/0255599 | A1* | 10/2013 | Jentz | F01P 11/14 123/41.1 |
| 2013/0255603 | A1 | 10/2013 | Pursifull et al. | |
| 2013/0264047 | A1 | 10/2013 | Charnesky et al. | |
| 2013/0338870 | A1 | 12/2013 | Farmer et al. | |
| 2014/0299077 | A1 | 10/2014 | Sowards et al. | |
| 2015/0088400 | A1 | 3/2015 | Bühler et al. | |
| 2015/0152776 | A1 | 6/2015 | Fischer et al. | |

FOREIGN PATENT DOCUMENTS

| | | | |
|---|---|---|---|
| CN | 104097504 | | 10/2014 |
| CN | 104675500 | | 6/2015 |
| DE | 35 33 093 | | 3/1987 |
| DE | 100 58 775 | A1 | 6/2002 |
| DE | 10 2012 103 464 | A1 | 10/2013 |
| DE | 10 2013 205 229 | A1 | 10/2013 |
| DE | 10 2014 103 667 | A1 | 10/2014 |
| FR | 2941894 | | 8/2010 |
| JP | 2013-226958 | | 11/2013 |

OTHER PUBLICATIONS

Chinese Office Action issued in 201610405549.8 dated Apr. 4, 2018.

* cited by examiner

FLAPPER VALVE DEVICE WITH FUNCTIONAL TESTING

CROSS REFERENCE TO RELATED APPLICATION(S)

This application claims priority to German Application No. 10 2015 210 683.7, filed Jun. 11, 2015. The entirety of the disclosure of the above-referenced application is incorporated herein by reference.

BACKGROUND OF THE INVENTION

Field of the Invention

The present invention relates to a device for convective cooling of a functional assembly, wherein the device comprises:

- a fan which in operation is designed to move air along a flow axis defined by the design and placement of the fan,
- a flapper valve device including an air transit opening and a flapper valve assembly disposed therein including at least one flapper valve, which for changing the flow-through cross-section of the air transit opening is adjustable between a closed position, wherein the flow-through cross-section of the air transit opening along the flow axis is minimal, preferably zero, during operation, and an open position, wherein the flow-through cross-section of the air transit opening along the flow axis is maximal during operation, and
- a control unit, wherein the fan and the flapper valve device are disposed at a distance from each other such that air moved due to operation of the fan flows through the air transit opening at least when the flapper valve device is in the open position.

Devices of this kind for convective cooling are known, for example, from motor vehicles, where they are used inter alia to restrict the volume of air flowing through a radiator grill, such as into the engine compartment, by changing the available flow-through cross-section of the air transit opening. The air flow can be generated by the movement of the vehicle and branch off from the airstream thus generated. In the absence of this airstream or if the airstream is insufficient, the air stream can also be generated by the fan mentioned above.

By changing the flow-through cross-section of the air transit opening, motor vehicle cold-start phases can be shortened and thus the internal combustion engine can be warmed up to nominal temperature more quickly, which reduces the pollutant emissions from a motor vehicle.

Devices of this kind for convective cooling are used in particular for cooling of the cooling fluid, in particular the coolant, used for temperature control of the internal combustion engine. Likewise a device of this kind can be used to cool brake fluid or a lubricant, such as engine oil, thus in general to cool an operating fluid in the operation of a motor vehicle. For this reason the fan is preferably disposed such that an air stream generated thereby flows onto, around or through a heat exchanger circulating the operating fluid.

Likewise, the fan is disposed relative to the flapper valve device such that the air moved by the fan when in operation flows through the air transit opening when the opening is opened due to the adjusted operating position of the flapper valve device. The air moved by the fan can be air from the intake stream, that is, air flowing toward the fan to the vacuum side of the fan, or it can be air from the exhaust stream, i.e., air moving away to the pressure side of the fan.

Since the device described herein for convective cooling represents an emission-relevant system due to its influence on the pollutant emissions from a motor vehicle, with regard to the increasingly stricter legal requirements with respect to environmental matters, it is important that the cooling device be testable as to whether it functions properly or not. Such a testability ensures that any undesirable damages that increase the pollutant emission from an internal combustion engine can be quickly recognized and corrected.

Heretofore the flapper valve device has been monitored via a query of the position of a so-called "drive flap," and even this monitoring takes place only indirectly via the actuator or actuators provided for adjusting the at least one flapper valve between its operating positions, and specifically using a so-called actuator calibration.

In many flapper valve devices in the prior art only one flapper valve of a plurality of flapper valves is driven directly by an actuator, only the so-called "drive flap." The remaining flapper valves of the flapper valve device are coupled to the drive flap solely for coordinated movement and are thus moved only indirectly by the actuator.

However, monitoring of the operating position of the flapper valve device solely by monitoring of the position of the drive flap presumes that the flapper valve device is functional overall. Thus if the drive flap is detected in the correct position, but only the position of the drive flap is located in the detected position, whereas the remaining flapper valves assume a different position due to a defect in the movement coupling, then the result of the monitoring of the flapper valve device or of the device for convective cooling is incorrect overall.

SUMMARY OF THE INVENTION

Therefore it is the object of the present invention to specify a technical teaching using which the above-mentioned device for convective cooling can be further developed, such that the actual operating state of the device can be determined in a simple and reliable manner.

The present invention achieves this object using a device of the above-described type, wherein the control unit is designed so as to detect, during operation of the fan, at least one operating parameter of the fan and, proceeding from the detected operating parameter, to draw a conclusion about the actual operating state of the flapper valve device.

Owing to the stated relative positioning of fan and flapper valve device, during operation the flapper valve device can directly influence air moved by the fan, which leads to repercussions on the fan operation. Under the assumption of the stated relative placement with respect to the fan, from an abstract point of view the flapper valve device produces a variable flow resistance of the air moved by the fan during operation, which then influences the operation of the fan. This influence of the variable flow resistance of the flapper valve device on the operation of the fan can be at least schematically-qualitatively recognized by detection of at least one operating parameter of the fan, which in turn makes possible a conclusion about the actual operating state of the flapper valve device.

The advantage of the determination proposed here of the actual operating state of the flapper valve device is not only in the reliable detection of the actual operating state, but rather also in the simple detection thereof, since the solution proposed by the invention manages without position sensors, switches and the like for the detection of the flapper valve positions. Thus to realize the device proposed here no additional data or/and energy inputs to control devices or control units are needed. Any software used in the control devices need not be expanded with additional monitoring functionalities to control additional sensors; no additional cables are needed and no additional load on any existing data networks will occur, such as on the LIN- or CAN-buses used in motor vehicles.

The terms "operationally minimal" and "operationally maximal" are intended to designate the minimal or maximal intended flow-through cross-section of the air transit opening in intended operation. It should thus not be precluded that it is possible to position the flapper valve device in another position wherein the open-flow cross section of the air transit opening is even smaller or even larger, which does not arise, however, in intended operation. "Intended operation" here designates exclusively the operation of the flapper valve device for changing the air stream passing through the air transit opening, but not an idle operation or similar special operating mode wherein the flapper valve device can be set into an otherwise unattainable idle position or comparable special position for reasons of maintenance access.

The at least one detected operating parameter of the fan can actually be any arbitrary operating parameter, such as its rotational speed or its power. The use of an operating parameter related to the power consumption of the fan is advantageous since the fan must expend different amounts of energy, that is, different amounts of power, to overcome the flow resistance of the air moved per time unit by the operating fan depending on the position of the flapper valve device.

In principle the fan can be driven by means of any physical active principle. But as a rule the fan will be an electrically driven fan. For this reason it is preferred that the detected operating parameter is an electrical quantity that changes with the electric power supplied to the fan for operation thereof.

With many electric motors the motor current needed by the motor changes with the torque output from the motor. Therefore with electrically driven fans it is preferable for the detected operating parameter to be the current strength of the operating current supplied to the fan. This is also understandable for an additional reason: The power consumed by the fan is the product of the voltage applied to the fan and the operating current supplied to the fan. The voltage in the preferred application case here of the inventive device is as a rule the constant on-board voltage supplied by the battery or generator in a motor vehicle. Therefore the flow resistance produced by the flapper valve device and acting against the fan its operation leads essentially to a change in the operating current of the fan.

Immediately after switching on the fan, transient values of operating parameter values can be detected until a quasi-stationary operating state of the fan is attained; these values provide only limited information. To ensure that the correct conclusion can be drawn from the detected operating parameter about the correct, actual operating state of the flapper valve device, according to one preferred further development of the present invention the control unit is designed so as to detect the operating parameter at a temporal interval after operational startup of the fan.

Preferably the control unit is designed to detect the operating parameter multiple times, wherein the individual measurements occur at different times, so as to be able, for example, to recognize the particularly informative quasi-stationary operating state of the fan. This quasi-stationary operating state can be recognized, for example, in that a detected value of the operating parameter does not change by more than a predetermined limit value over a plurality of temporally sequential measurements. Particularly preferably, the control unit can be designed to detect the operating parameter continuously over a period of time.

The detecting of the operating parameter in the sense of the present invention is equivalent to the detecting of a parameter different from the operating parameter, which parameter behaves in a known relationship with the operating parameter, such as being linearly proportional to the operating parameter, at least in the range of values expected for intended operation.

To draw a conclusion about the actual operating state of the flapper valve device starting from the detected operating parameter, the control unit can be designed to compare the detected operating parameter with at least one comparison value and to draw a conclusion about the actual operating state depending on the outcome of the comparison.

The comparison value can be a threshold value, wherein the control unit can be designed according to an a preferred further development of the present invention, to conclude that a first operating state is the present operating state of the flapper valve device when the detected operating parameter is greater than the comparison value or/and to conclude that a second operating state is the present operating state of the flapper valve device when the detected operating parameter is less than the comparison value. In this manner, based on a detected operating parameter, a decision can be made in a simple and reliable manner about which of two operating states is the current actual operating state of the flapper valve assembly.

Alternatively or additionally, the control unit can be designed to check whether the detected operating parameter is located within at least one predetermined value range, and then, if the detected operating parameter is located within the predetermined value range, to conclude that an operating state associated with this value range is the actual operating state of the flapper valve device. In this manner as many operating states can be recognized as actual operating states of the flapper valve device as there are value ranges defined that are each associated with one of the operating states.

Consequently, the control unit can be designed to check whether the detected operating parameter is located in a predetermined value range of a plurality of predetermined value ranges, wherein different value ranges are associated with different operating states of the flapper valve device, wherein the control unit is furthermore designed such that if the detected operating parameter is located in a value range of the plurality of predetermined value ranges, the control device concludes that the operating state associated with this value range is the actual operating state of the flapper valve device.

Therefore the control unit can comprise a data memory. The value ranges, operating states, and the associations between them can be stored in this memory.

In a simple case already suggested above, wherein it may be sufficient for the control unit to differentiate only between two operating states of the flapper valve assembly, the plurality of predetermined operating states can comprise an error-free and an error-laden operating state of the flapper valve device. For example, the control unit can then conclude that the flapper valve device is functioning in an error-free manner when the detected operating parameter is greater than the above-mentioned threshold value, and can conclude the presence of an error in operation of the flapper valve device when the detected operating parameter is less than or equal to the mentioned threshold value. The same applies accordingly for the presence of the detected operating parameter in a predetermined value range if only two value ranges are defined. The above association is provided solely as an example. It can also be reversed with respect to the above example.

Since the flow resistance caused by the flapper valve device, which affects the operation of the fan, is significantly determined by the position of the flapper valve assembly, according to another advantageous further development of the present invention the control unit can conclude that one operating state of a plurality of predetermined operating states is the actual operating state of the flapper valve device, wherein the plurality of predetermined operating states comprises the flapper valve assembly being in one of at least two operating positions of closed position, open position and an intermediate position located between the open position and closed position. Preferably the plurality of predetermined operating states comprises the flapper valve assembly being in an operating position which is the closed position, the open position and one or several intermediate positions located between the open and closed positions.

The detection of an error-laden or error-free operating state of the flapper valve device can also be implemented in several steps, for example, in that the control unit—as explained above—draws a conclusion about the operating position of the flapper valve assembly and/or of the flapper valve device, then this inferred operating position is compared to a target operating position and, depending on the comparison, an error-free or an error-laden operating state of the flapper valve device is deduced. For example, if the control unit determines that the actual operating position differs from a relevant target operating position, an erroneous operating state of the flapper valve device is deduced. Thus the control unit can be designed in this manner.

To obtain an as effective-as-possible reaction of the flapper valve device to the operation of the fan, it is advantageous if the flapper valve device has as large as possible an influence on the air flow generated by the fan in operation. This can be achieved by a design wherein the fan is directly adjacent to the flapper valve device in the direction of the flow axis. In this case no additional functional unit is located along the flow axis between the flapper valve device and the fan. Preferably the flapper valve device is disposed on the pressure side of the fan.

Since the fan or/and the flapper valve device are operated or adjusted in a generally favorable manner, depending on the operating states of a higher-order entity or other functional units containing them, such as a motor vehicle, a control unit is advantageously provided to control the operation of the fan or/and to control the adjustment of the flapper valve assembly. In principle this can be a separate control unit. To obtain a design with preferably the smallest number of assemblies to create the device under discussion herein, the control unit is further advantageously designed to control the operation of the fan or/and to adjust the flapper valve device.

The present invention further relates to a motor vehicle including a device for convective cooling of a functional assembly, like that described above.

According to a further aspect of the present invention the object stated above is also achieved by a method for determining an actual operating state of a flapper valve device, which is disposed in an operating air stream generated by a fan, comprising the following steps:

Detecting of at least one operating parameter of the fan, in particular an electrical quantity which changes with the electric power supplied to the fan, particularly preferably the electric current supplied to the fan, Comparing the detected operating parameter with a characteristic map wherein values of the operating parameter are associated with operating states of the flapper valve device, and Determining the operating state associated with the detected operating parameter to be the actual operating state of the flapper valve device.

To explain the inventive method, reference is made to the detailed explanation of the inventive device provided above.

The method can comprise a targeted attaining of a predetermined operating position of the flapper valve device, so that based on the previously described detection routine it can be determined whether the predetermined operating position was properly achieved. The method can comprise the attaining of a plurality of predetermined operating positions of the flapper valve device, wherein after a plurality of attaining processes, preferably after each attaining process, at least the previously described step of detection of the at least one operating parameter is carried out, in order to be able to check whether each of the plurality of operating positions is in fact attained by the flapper valve device. For this purpose the detected operating parameters can be compared to a characteristic map as described above, and depending on the respective result of the comparison, an operating state of the flapper valve device can be determined. In this manner a sensor-free test routine can be provided for functional testing of the flapper valve device. This can occur in a short time, perhaps automatically immediately after a vehicle start or during stop periods at traffic lights, or in general upon request by the vehicle driver.

The designs of the control unit disclosed in the present application as respective further developments of the present invention likewise represent refinements of the inventive method for solving the problem stated above, since the designs of the control unit described in detail above each define a design to implement the steps required by the application, and thus represent a design to implement the method or partial method.

To ensure sufficient redundancy, the control unit can be designed to detect a plurality of different operating parameters, or during the implementation of the inventive method, to detect a plurality of different operating parameters.

The present application also relates to a motor vehicle including a device like that described above for conductive cooling, or/and to a motor vehicle which is designed to carry out the method described above.

The expressions "operating position of the flapper valve device" and "operating position of the flapper valve assembly" used in the present application are synonymous.

BRIEF DESCRIPTION OF THE DRAWING FIGURES

Figure 2:
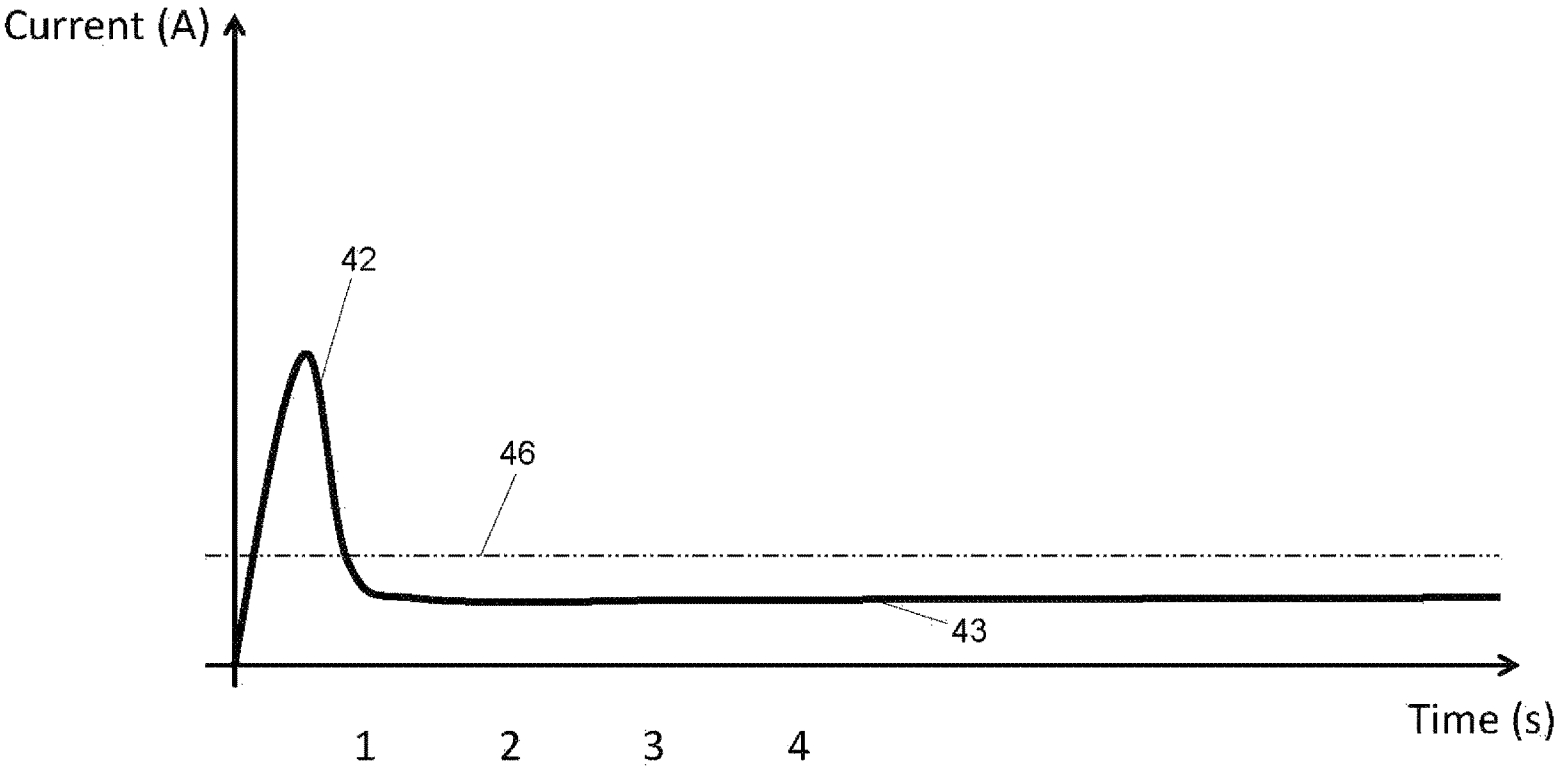
Figure 3:
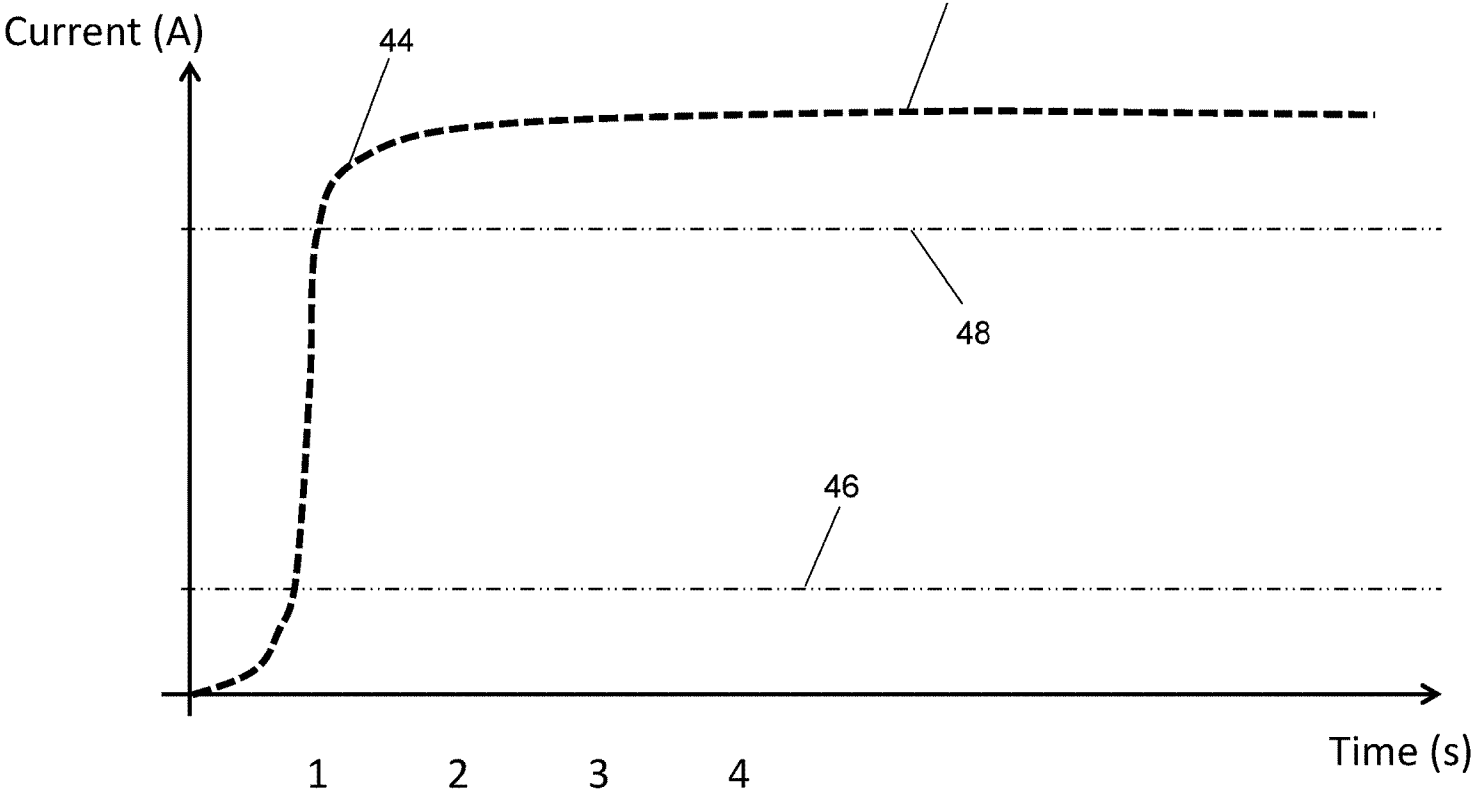
Figure 4:
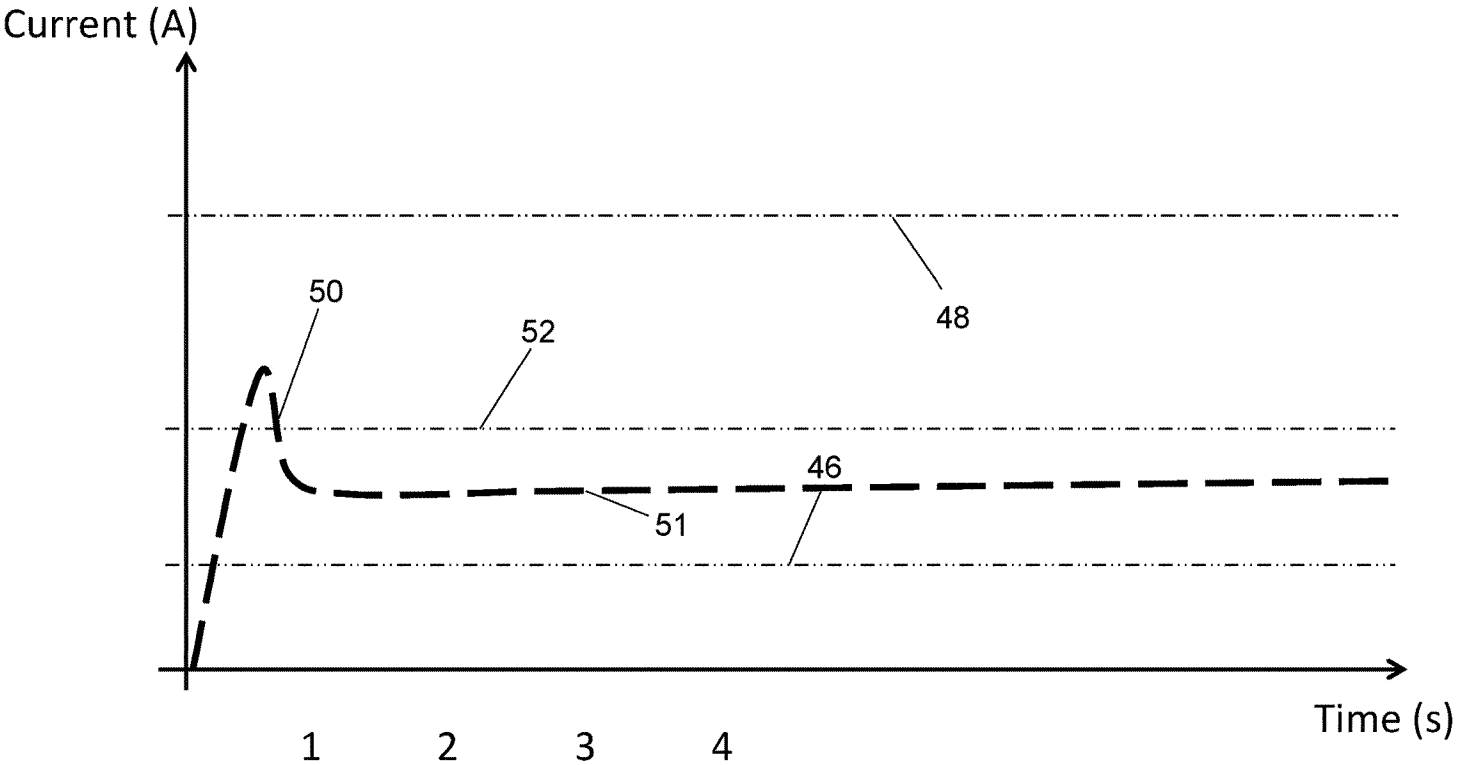
Figure 5:
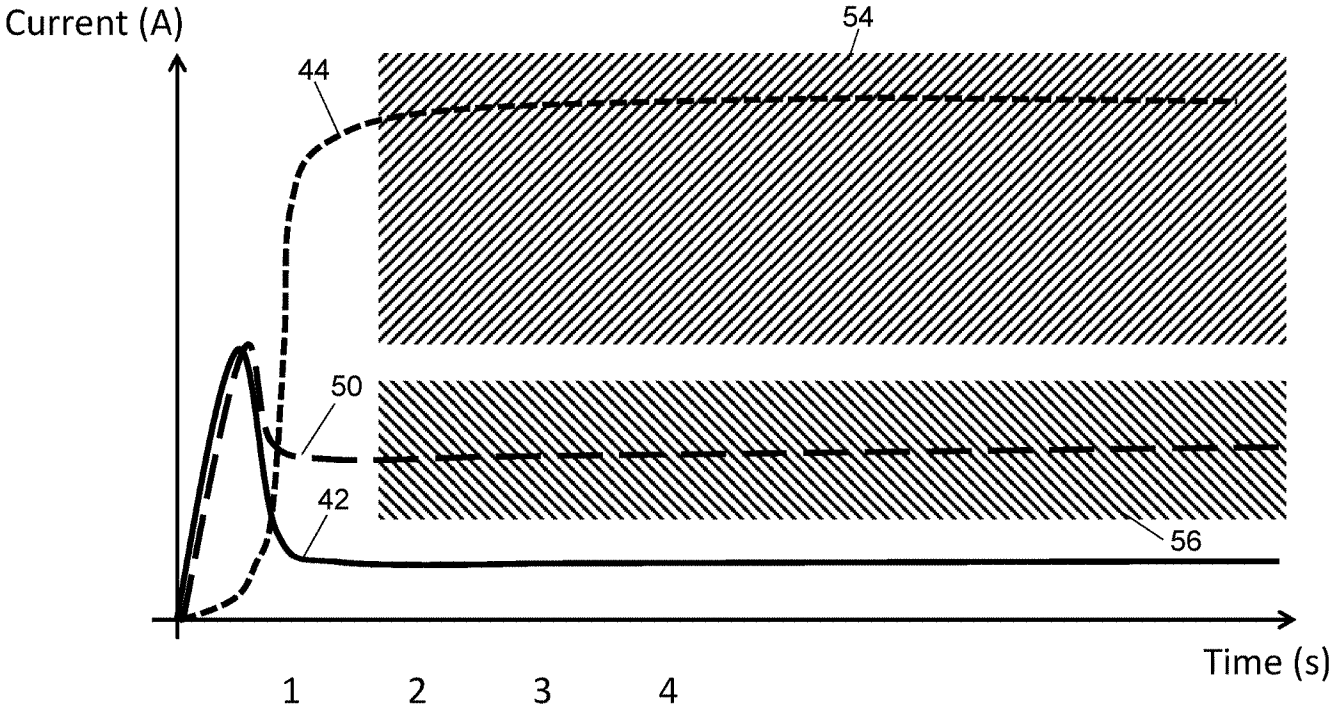

The present invention will be explained in greater detail below based on the accompanying drawings:

FIG. 1 depicts a rough, schematic, longitudinal cross-section through a motor vehicle including a device according to the invention for convective cooling of cooling fluid of the internal combustion engine, FIG. 2 depicts a graph which shows the relationship between the operating current consumed by the fan of the device of FIG. 1, and the operating time when the flapper valve device of the device of FIG. 1 is located in the open position, FIG. 3 depicts a graph which shows the relationship between the operating current consumed by the fan of the device of FIG. 1, and the operating time when the flapper valve device of the device of FIG. 1 is in the closed position, FIG. 4 depicts a graph which shows the relationship between the operating current consumed by the fan of the device of FIG. 1, and the operating time when the flapper valve device of the device of FIG. 1 is in an intermediate position between the open position and closed position, and FIG. 5 depicts the graphs of FIGS. 2 to 4 in a common diagram with characteristic maps indicated therein which are assigned to different actual operating states of the flapper valve device.

An outline of the front section of a motor vehicle (PKW) indicated roughly by dashed lines and which is denoted in general by reference number 10 is depicted in FIG. 1. A front wheel 12 is indicated, which likewise is depicted in outline only in a rough, schematic manner using dashed lines.

DETAILED DESCRIPTION OF THE PREFERRED EMBODIMENTS

In the front section 10 of the motor vehicle, an internal combustion engine 14 is indicated by dashed lines. As is generally commonplace, this engine is cooled by a liquid coolant. In order to remove the heat supplied to the coolant by the internal combustion engine 14, a heat exchanger 16 is provided to which the liquid coolant is supplied at an elevated temperature through a hose or tubing 18 and from which the liquid coolant is returned via a similar line at lower temperature back to the internal combustion engine 14. Thus the liquid coolant circulates between the internal combustion engine 14 and the heat exchanger 16.

In the exemplary embodiment under discussion here, the liquid coolant is mentioned only as an example. Instead of the liquid coolant, a brake fluid, a lubricant such as motor oil, or another liquid heated by operation of the motor vehicle can be supplied to a heat exchanger 16 for convective cooling.

The heat exchanger 16 during operation of the motor vehicle is convectively cooled by an air stream which moves essentially in the vehicle's longitudinal direction F and is symbolized in FIG. 1 by the arrows L. The arrows L extend along the flow axis S of the air stream.

The air flow L can be generated either by the airstream during forward movement of the motor vehicle or by a fan 20, for example, when the motor vehicle is stopped.

In a known manner the fan 20 comprises a fan shaft 22 including fan blades 24 fixedly attached thereon. A fan drive unit 26 connected to the fan shaft 22 provides the energy required to move the fan shaft 22 with fan blades 24 rotating in the same direction as the fan shaft to generate the air flow L.

Here the fan 20 is disposed preferably directly adjacent to a flapper valve device 28 in the direction of flow of the air stream L. The flapper valve device 28 comprises a frame 30 which surrounds an air transit opening 32, and in which a flapper valve assembly 34, including a plurality of moveable flapper valves 36, is disposed. In the illustrated example, the flapper valves 36 are parallel to the flapper valve assembly 34 and are disposed essentially in the vehicle transverse direction Q; this corresponds to a direction orthogonal to the drawing plane of FIG. 1. The flapper valves 36 are pivotable for adjusting between an open position wherein the open cross-section of the air transit opening 32 is at an operating maximum, and a closed position wherein the open cross-section of the air transit opening 32 is at an operating minimum. In the illustrated example the flapper valves 36 can pivot about stationary axes of rotation D extending parallel to the vehicle's transverse direction.

The term "operating" minimum or maximum is intended to indicate that the closed position and/or the open position of the flapper valve assembly 34 during intended operation provides the smallest or the largest flow-through cross-section of the air transit opening 32 for a volume change of the air stream L transiting the air transit opening 32. However, this does not preclude there being special operating modes outside of the intended operation stated above, such as a maintenance operating mode or the like, wherein by starting up to a special position of the flapper valve assembly 34 an even greater, or an even smaller open cross section of the air transit opening 32 can be attained.

An actuator 38 is indicated only by a rough schematic in FIG. 1, which actuator forms the rotary drive unit of the flapper valve assembly 34 for adjusting the flapper valves 36 of the flapper valve assembly 34 between the stated operating positions: open position and closed position.

The device depicted in FIG. 1 further comprises a control unit 40 which is preferably configured to control operation of both the fan actuator or fan drive unit 26 and also the flapper actuator 38. This means, for example, that the control unit 40 controls or even regulates the energy supply to the fan actuator or flapper drive 26 and the flapper actuator 38.

In any event the control unit 40 is designed to detect an operating parameter of the fan 20; in the illustrated example, for instance, the operating current drawn by the fan 20 or by the fan drive unit 26.

Depending on the operating setting of the flapper valve assembly 34 of the flapper valve device 28, the flow resistance to be overcome by the air stream L will increase or decrease. Since the fan 20 is disposed relative to the flapper valve device 28 such that an air stream L generated by it flows through the air transit opening 32, the flow resistance generated as a function of the operating setting of the flapper valve assembly 34 acts against the fan 20 if the air stream L flowing through the air transit opening 32 was generated by the fan 20.

As is generally common in motor vehicles, the fan 20 is preferably mounted in an intake position with respect to the heat exchanger 16, that is, the heat exchanger 16 is located on the intake side (vacuum side) of the fan 20 and the flapper valve device 28 on its pressure side (high-pressure side). During operation of the fan, the fan 20 thus suctions air through the heat exchanger 16 and the air heats up during its passage through the heat exchanger 16 and thus cools off the coolant liquid also flowing through the heat exchanger. The fan 20 forces the heated air through the flapper valve device 28 to the outside (left arrow point of the air stream L in FIG. 1).

In contrast thereto, if the heat exchanger 16 is to be cooled convectively by the airstream, the air stream will flow past the heat exchanger 16 in the vehicle longitudinal direction from the vehicle front side to the vehicle rear (right arrow points of the air stream L in FIG. 1).

Then if the heat exchanger 16 is to be convectively cooled by operation of the fan 20, it is important that the heated air can escape at the pressure side of the fan 20 through the flapper valve device 28 into the environment outside of the motor vehicle.

In order to prevent overheating of the internal combustion engine 14 or to avoid any unnecessary generation of pollutants from the motor vehicle, perhaps because the flapper valve device 28 is in the open position despite a cold start of the engine 14, and thus the heating of the engine 14 to its nominal operating temperature is needlessly delayed, it is helpful to check or to monitor the functional integrity or the orderly functioning of the flapper valve device 28.

This monitoring can take place in a very simple manner without additional sensors, as described below:

FIG. 2 depicts a relational diagram between the operating current consumed by the fan 20 and the operating time of the fan 20. The abscissa of the diagram of FIG. 2 shows the operating time in seconds; the ordinate of the diagram of FIG. 2 shows the current strength of the operating current in Amperes. The graph 42 shown in the diagram of FIG. 2 thus indicates what operating current is consumed by the fan 20 at which point in time after the operational start (t=0 s). It is evident that after an approximately one-second transient, start-up phase, the fan assumes a quasi-stationary operating state and for the subsequent operating time consumes a roughly constant, low operating current.

This temporally constant operating current is at such a low level because the flapper valve device 28 is in its open setting and thus the open cross-section of the air transit opening 32 is at its operating maximum. Thus the fan 20 has to overcome an operationally minimal flow resistance in order to move air from the heat exchanger 16 through the flapper valve device 28 into the area outside of the motor vehicle.

In contrast, FIG. 3 depicts the chronology 44 of the operating current consumed by the fan 20 when the flapper valve device 28 is in the closed position. Since the open cross-section of the air transit opening 32 is then at its operating minimum, the flow resistance opposing the air stream L from the flapper valve device 28 is at its operating maximum. The fan 20, which must work against the flow resistance established by the flapper valve device 28, consumes a significantly greater operating current when the flapper valve device 28 is in the closed position, after the transient start-up phase, than in the case shown in FIG. 2 where the flapper valve device 28 is in the open position.

Also in the case depicted in FIG. 3, after a transient start-up phase a quasi-stationary operating state occurs which continues during the subsequent operating time.

For example, based on the graph 42, a threshold value 46 of the operating current can be defined which can be used to determine whether the flapper valve device 28 is in the open position or not. Then if the quasi-stationary curve portion of the operating current is below the threshold value 46, it can be concluded that the flapper valve device 28 is in the open position. But if the quasi-stationary curve portion of the operating current is above the threshold value 46, it can be concluded that the flapper valve device 28 is at least not in the open position. The threshold value 46 (first threshold value) can be determined based on the level of the quasi-stationary curve portion 43 of the graph 42, perhaps also under consideration of the usual operating fluctuations and tolerances.

Likewise, based on the graph 44 in FIG. 3, an additional threshold value 48 of the operating current can be defined, which makes it possible to determine whether the flapper valve device 28 is in the open position or not. Then if the quasi-stationary curve portion 45 of the graph 44 is above the threshold value 48, it can be concluded that the flapper valve device 28 is in the closed position. But if this is not the case, it can be concluded that the flapper valve device 28 is not in the closed position. The threshold value 48 (second threshold value) can in turn be determined based on the value of the quasi-stationary portion 45 of the temporal profile 44 of the operating current, under consideration of the usual operating fluctuations and tolerances.

Finally FIG. 4 shows a profile 50 of the operating current of the fan 20 as a function of operating time as it occurs when the flapper valve device 28 is in an intermediate position between the open position and the closed position.

After a transient start-up phase which ends about 1 second after the engine start, a quasi-stationary operating state of the fan again sets in, during which the operating current consumed by the fan 20 changes very little.

Again based on the quasi-stationary portion 51 of graph 50, in an analogous manner to the procedure described above a threshold value 52 (third threshold value) can be defined which is used to draw a conclusion about whether the flapper valve device 28 is in the intermediate position.

The conclusions discussed above about a particular operating state of the flapper valve device 28 based on the relative position of the quasi-stationary curve portion of the temporal profile of the operating current consumed by the fan 20 relative to the specified threshold values can be obtained in a simple manner from the control unit 40 and can be saved in a data memory with the threshold values 46, 48, 52. After passage of a predetermined period of time after the operating start-up of the fan 20, the detected values of operating current can be compared to the threshold values 46 and/or 48 and/or 52 and then, depending on the result of the comparison and based on the relationships described above, a conclusion can be drawn about what position the flapper valve device 28 is in, or at least in what position the flapper valve device 28 is not in.

The position of the flapper valve device 28 determined in this manner, or even the position determined not to be assumed by the flapper valve device 28, can be compared to a desired operating position of the flapper valve device 28, based on additional data saved in the control unit 40, so that the control unit 40 can conclude an orderly functioning of the flapper valve device 28 if the determined position of the flapper valve device 28 coincides with the desired operating position.

According to one refinement of the present invention it is also possible that a predetermined program will be executed in the control unit 40 for functional testing of the flapper valve device 28, according to which the flapper valve assembly 34 is adjusted into differently defined operating positions, and by operation of the fan it can be determined in the manner described above whether the flapper valve device 28 is in fact in the respective selected operating position or not.

The graphs 42, 44 and 50 from FIGS. 2 to 4 are presented in a single diagram in FIG. 5. The diagram of FIG. 5 additionally contains a first characteristic map 54 and a second characteristic map 56. The first characteristic map 54 extends across a first value range of operating current strengths and also across a range of operating times. An operating state of the flapper valve device 28 is associated with this first value range, for example, an operating state of "located in a predominately closed state" or—if the diagram of FIG. 5 is assigned to a desired operating state of predominately closed position of the flapper valve device 28—an operating state of "functioning in an orderly manner."

Accordingly, the value range of the second characteristic map 56, which is preferably entirely different from the first value range, can be associated with an additional operating state, for example, an operating state of "not in a sufficiently closed state," or "not functioning in an orderly manner." The use of characteristic maps also makes it possible to operate in specific operating positions of the flapper valve device 28 and to test the selected operating positions by switching on the fan 20 and detecting the operating current consumed by the fan in a quasi-stationary operating state.

The control unit 40 can write an error message or other appropriate information into the error data memory of the motor vehicle, depending on the determined actual operating state of the flapper valve device 28.

The possibility for monitoring of the functional integrity of the flapper valve device 28 proposed in the present application is particularly advantageous because the monitoring of the monitoring result is possible with great reliability without the need to install any otherwise required sensors, lines, software and the like.

The invention claimed is:

1. Device for convective cooling of a functional assembly, the device comprising:

a fan which in an air moving operation is configured to move air along a flow axis defined by the design and placement of the fan;

a flapper valve device including an air transit opening and a flapper valve assembly disposed therein, including at least one flapper valve provided to change the flow-through cross-section of the air transit opening along the flow axis between a closed position in which the flow-through cross section of the air transit opening is minimal during operation, and an open position in which the flow-through cross section of the air transit opening along the flow axis is maximal during operation; and a control unit;

wherein the fan and the flapper valve device are disposed at a distance from each other such that air moved due to the air moving operation of the fan then flows through the air transit opening at least when the flapper valve device is in the open position; and wherein the control unit is configured to detect during the air moving operation of the fan at least one operating parameter of the fan and then, proceeding from the detected at least one operating parameter, to draw a conclusion about the actual operating state of the flapper valve device, the detected at least one operating parameter of the fan including an electrical quantity that changes with the electric power supplied to the fan during the air moving operation thereof.

2. The device according to claim 1, wherein the detected operating parameter is the current strength of the operating current supplied to the fan.

3. The device according to claim 1, wherein the control unit is designed so as to detect the operating parameter at a temporal interval after a start of operation, wherein the individual measurements occur at different times.

4. The device according to claim 3, wherein the control unit is designed to detect the operating parameter continuously over a period of time.

5. The device according to claim 1, wherein the control unit is designed to compare the detected operating parameter with at least one comparison value and to draw a conclusion about the actual operating state depending on the comparison.

6. The device according to claim 5, wherein the comparison value is a threshold value, wherein the control unit is designed to conclude that a first operating state is the actual operating state of the flapper valve device when the detected operating parameter is greater than the comparison value and/or to conclude that a second operating state is the actual operating state of the flapper valve device when the detected operating parameter is less than the comparison value.

7. The device according to claim 1, wherein the control unit is designed to check whether the detected operating parameter is located in at least one predetermined value range, and then, if the detected operating parameter is located in the predetermined value range, to conclude that the operating state assigned to this value range is the actual operating state of the flapper valve device.

8. The device according to claim 7, wherein the control unit is designed to check whether the detected operating parameter is located in one predetermined value range of a plurality of predetermined value ranges, wherein different value ranges are associated with different operating states of the flapper valve device, wherein the control unit is further designed so as, if the detected operating parameter is located in one value range of the plurality of predetermined value ranges, to conclude that the operating state associated with this value range is the actual operating state of the flapper valve device.

9. The device according to claim 1, wherein the control unit concludes that an operating state of the plurality of predetermined operating states is the actual operating state of the flapper valve device, wherein the plurality of predetermined operating states comprises an error-free and an error-laden operating state of the flapper valve device.

10. The device according to claim 1, wherein the control unit concludes that an operating state of a plurality of predetermined operating states is the actual operating state of the flapper valve device, wherein the plurality of predetermined operating states comprises the flapper valve assembly being in one of at least two operating positions of closed position, open position and an intermediate position located between the open position and closed position.

11. The device according to claim 9, wherein the control unit is designed to compare the determined presence of an operating position with a target operating position, and depending on this comparison, to conclude the presence of an error-free or of an error-laden operating state of the flapper valve device.

12. The device according to claim 1, wherein the fan is directly adjacent to the flapper valve device in the direction of the flow axis.

13. The device according to claim 1, wherein the control unit is additionally designed to control the operation of the fan and/or to control an adjustment of the flapper valve assembly.

14. Motor vehicle including a device according to claim 1.

15. The device according to claim 1, wherein the open-flow cross section of the air transit opening along the flow axis is zero when the at least one flapper valve is in the closed position.

16. Method for determining the actual operating state of a flapper valve device which is disposed in an air stream generated in an air moving operation by a fan, comprising the following steps:

detecting of at least one operating parameter of the fan during the air moving operation of the fan, the detected at least one operating parameter of the fan including an electrical quantity which changes with the electric power supplied to the fan;

comparing the detected operating parameter with a characteristic map wherein values of the operating parameter are associated with operating states of the flapper valve device;

determining of the operating state associated with the detected operating parameter as the actual operating state of the flapper valve device.

17. The method according to claim 16, further comprising a step of attaining of one or more predetermined operating positions of the flapper valve device, wherein after at least a part of the attained operating positions, at least the step of detecting of at least one operating parameter is executed, wherein the step of comparing with a characteristic map and the step of determining the actual operating state of the flapper valve device are carried out for a plurality of the detected operating parameters.

18. The method according to claim 17, wherein the step of comparing with a characteristic map and the step of determining the actual operating state of the flapper valve device are carried out for each detected operating parameter.

19. The method according to claim 17, wherein, after each attained operating position, at least the step of detecting of at least one operating parameter is executed.

20. The method according to claim 19, wherein the at least one operating parameter is electronic current.

* * * * *